United States Patent [19]

Graham

[11] Patent Number: 4,644,332

[45] Date of Patent: Feb. 17, 1987

[54] DRY LUBE LEVEL SENSOR

[75] Inventor: Randall C. Graham, Nashville, Tenn.

[73] Assignee: Essex Group, Inc., Fort Wayne, Ind.

[21] Appl. No.: 788,904

[22] Filed: Oct. 18, 1985

[51] Int. Cl.[4] ..... G08B 21/00; H01H 35/18

[52] U.S. Cl. ..... 340/624; 137/558; 184/6.4; 200/84 C

[58] Field of Search ..... 340/624, 623; 73/307–309, 313; 307/118; 137/558; 122/504.2; 184/108, 6.4; 200/84 C

[56] References Cited

U.S. PATENT DOCUMENTS

| | | | |
|---|---|---|---|
| 3,204,230 | 8/1965 | Hosford, Jr. | 340/624 X |
| 3,588,404 | 6/1971 | Akeley | 200/84 C |
| 3,715,539 | 2/1973 | Silberg et al. | 200/84 C |
| 3,849,770 | 11/1974 | Hayashida | 340/623 |
| 3,849,771 | 11/1974 | Applin | 340/624 |
| 3,922,716 | 11/1975 | Arnold | 360/12 |
| 3,942,526 | 3/1976 | Wilder et al. | 200/84 C X |
| 3,949,360 | 4/1976 | Pignata et al. | 200/84 C X |
| 3,958,663 | 5/1976 | Moore | 184/108 X |
| 3,965,317 | 6/1976 | Gratzmuller | 340/624 X |
| 4,255,747 | 3/1981 | Bunia | 340/624 |
| 4,481,507 | 11/1984 | Takiguchi et al. | 340/692 X |

*Primary Examiner*—Glen R. Swann, III
*Assistant Examiner*—Thomas J. Mullen, Jr.
*Attorney, Agent, or Firm*—Francis J. Maguire, Jr.

[57] ABSTRACT

A dry lube level sensor for use in a verbal annunciation system for monitoring a wire fabrication process comprises a sealed float tube having a magnetic float for actuating a reed switch within an adapter which connects the float tube to a mounting base for providing a low level signal to the alarm system.

2 Claims, 3 Drawing Figures

DRY LUBE LEVEL SENSOR

CROSS REFERENCE TO RELATED APPLICATIONS

The invention described herein may employ some of the teachings disclosed and claimed in commonly owned copending applications filed on even date herewith by Graham, Ser. No. 788,990, entitled LOW COST VERBAL ANNUNCIATOR, Ser. No. 788,901, entitled A WIRE TANGLE SENSOR, Ser. No. 788,902, entitled A WIRE BREAK SENSOR, and Ser. No. 788,903, entitled A WIRE RUNTOGETHER SENSOR. Each of the above-listed copending applications are hereby expressly incorporated by reference.

TECHNICAL FIELD

The invention relates to process alarm systems and particularly to a dry lube level sensor for use with a verbal annunciator system.

BACKGROUND ART

Modern wire manufacturing processes often require fast response and quick corrective action to prevent production delays. For example, recently developed high speed wire manufacturing processes in which a heavy gauge wire is drawn down to a smaller size, e.g., #12 AWG to #22 AWG, can experience faults which, if not rapidly corrected, can cause expensive production shutdowns. Factories for making such wire may consist of a large number of such production units spread over a wide expanse and staffed only by a small number of maintenance personnel on an around-the-clock basis. Unfortunately, present alarming systems for detecting faults and producing audio and visual alarms are sometimes inadequate in providing sufficient information to immediately direct the maintenance personnel to the source of the problem in time to prevent production shutdowns.

In copending application Ser. No. 788,990 A LOW COST VERBAL ANNUNCIATOR, having the same inventive entity and assignee as the present application, is disclosed several unique sensors developed for use with that annunciator. Included among those unique sensors is the dry lube level sensor which is claimed in this application. Prior art level sensors for controlling level in a dry lube applicator have consisted of modified automotive carburators which tend to clog.

DISCLOSURE OF INVENTION

The object of the present invention is to provide a simple and inexpensive dry lube level sensor for use with a low cost verbal annunciator in a wire fabrication process and for control purposes in such a process.

According to the present invention, a dry lube level sensor for sensing the level of take-up lubricant in a dry lube applicator for use in a wire fabrication process comprises a float having a magnet attached thereto and inserted in a float tube for floating at a level determined by the level of take-up lubricant in the applicator reservoir, the magnet actuating a reed switch positioned near the bottom of the float tube for providing a contact closure in the presence of a dry lube level below which an abnormal level exists.

In further accord with the present invention, the float tube is capped at the top and bottom with suitable materials. The top cap has a vent for venting to atmosphere and the bottom cap has a tubing connector for connecting the dry lube level to the float switch from the applicator reservoir. The float switch assembly is mounted on a mounting base with an adapter within which the reed switch may be positioned in place by means of any convenient means such as epoxy, adhesive, etc.

In still further accord with the present invention, the dry lube level sensor may be used with a central monitoring and control panel which includes a plurality of cassette tape players, one for each sensed condition, for providing verbal message signals corresponding to abnormal sensed conditions. The signals are provided to a power amplifier and speaker for announcement to maintenance personnel for rapid response and corrective action.

Fabricated wires emerging from an enameling and curing process for spooling must be properly lubricated before spooling. The present invention provides a simple and inexpensive means of early detection of a low level dry lubricant level in an applicator. If a low level is detected a reed switch is actuated which provides a binary output signal to the central monitoring unit which in turn provides a verbal annunciation to maintenance personnel for immediate corrective action. In this way, the down time of a wire manufacturing process is minimized by immediately identifying the source of a potential problem which may be quickly corrected before causing a production shutdown. The use of a dry lube level sensor with a verbal annunciator provides an inexpensive and effective method of reducing unplanned shutdowns in a wire manufacturing plant.

These and other objects, features and advantages of the present invention will become more apparent in light of the detailed description of a best mode embodiment thereof, as illustrated in the accompanying drawings.

BEST MODE FOR CARRYING OUT THE INVENTION

Figure 2:
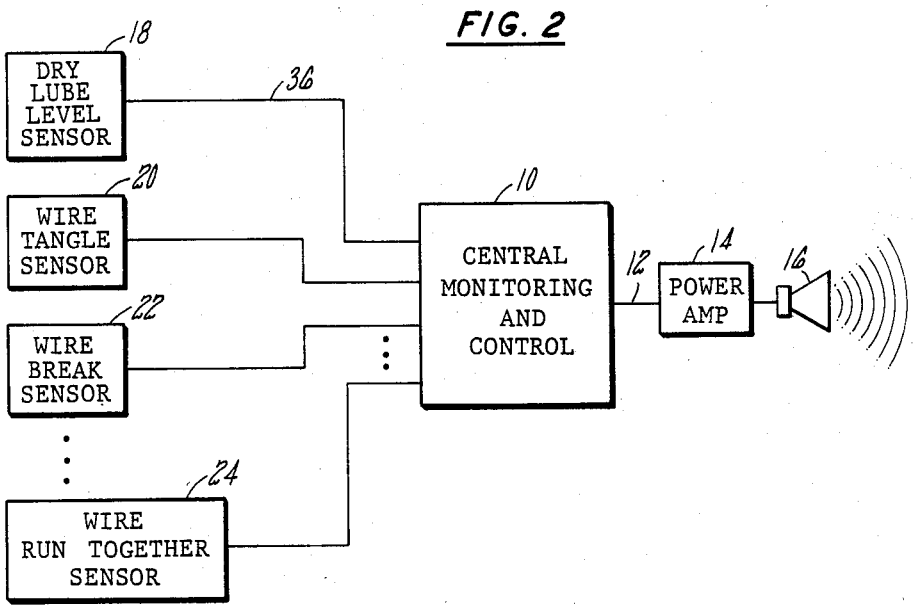
FIG. 2 is a block diagram illustration of a dry lube level sensor used in a low cost verbal annunciator system having a plurality of sensors for monitoring a wire fabrication process.
Figure 3:
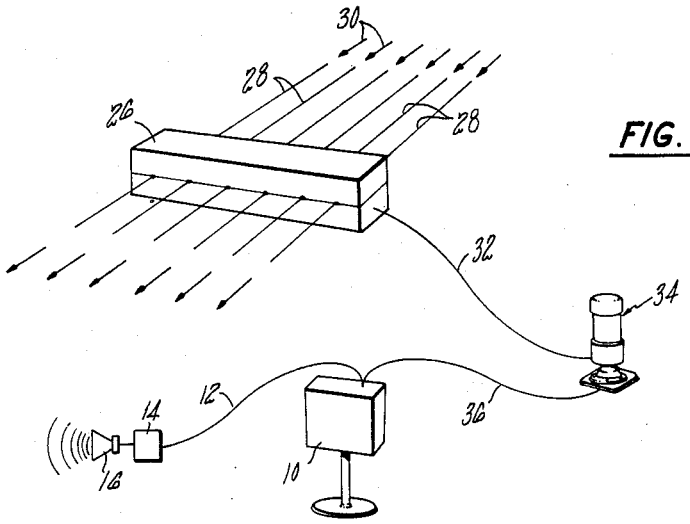
FIG. 3 is an illustration of a dry lube applicator connected to a float switch for providing a signal to an annunciator.

FIG. 2 is an illustration of a central monitoring and control panel 10, for monitoring the conditions of a plurality of remote sensors and for providing a verbal output message signal on a line 12 to a power amplifier 14 and speaker 16 for annunciating a verbal alarm message in the presence of a sensed abnormal condition on one of the sensors. The sensors may include a dry lube level sensor 18, a wire tangle sensor 20, a wire break sensor 22, and a wire runtogether sensor 24. Of course, the system of FIG. 3 is not limited to only those sensors listed, but may include others as well for monitoring a wire fabrication process. The central monitoring and control panel 10 contains a plurality of cassette tape players each responsive to the condition of one of the sensors. Each cassette tape player has a cassette tape within containing an endless tape with the appropriate message repeatedly recorded for endless annunciation until silenced.

FIG. 3 is an illustration of an applicator 26 receiving a plurality of fabricated wires 28 along the direction indicated by a plurality of arrows 30 for lubrication prior to spooling on take-up spools. A sensing tube 32 connects the applicator to a level sensor 34. If the dry lubrication in the applicator drops to a level below a selected level, an abnormal level signal on a line 36 is provided to the central monitoring and control panel 10, as also shown in FIG. 2. An alarm message signal on line 12 is then provided to the power amplifier 14 and speaker 16 for annunciation.

Figure 1:
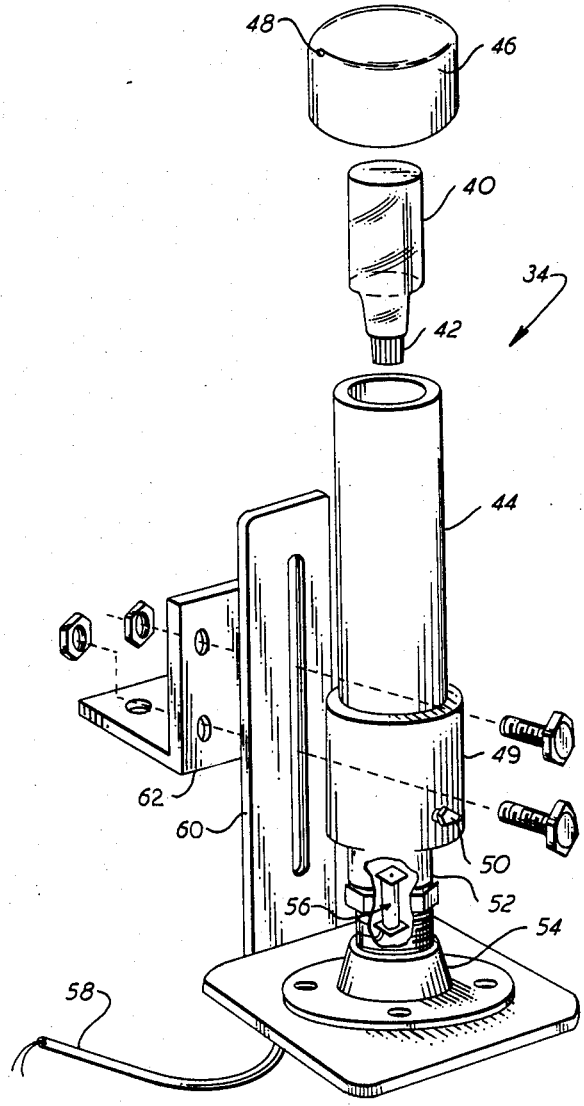
FIG. 1 is an exploded illustration of a dry lube level sensor, according to the present invention.

FIG. 1 is a more detailed illustration of the level sensor 34 of FIG. 3. A small empty polypropylene bottle 40, such as the type used by secretaries to correct typing errors, is attached to a magnet 42 by means of shrink tubing, or some other suitable means. The bottle and magnet float is inserted into a cylindrical body 44 which may be PVC thin walled tubing of a diameter suitable for permitting the bottle 40 to float freely. A cap 46, such as PVC, having a vent hole 48 is attached to the top of the main cylindrical body and is removable for permitting cleaning and to inspect the float. A bottom cap 49 to seal the bottom of the main tube 44 is provided with a brass tubing connector 50 for hookup to the sensing tube 32 of FIG. 3. An internal thread pipe adapter 52 is attached to the bottom cap 49 for connection to a pipe flange 54 used as a mounting base for the float switch. A small reed switch 56 is inserted and sealed inside the adapter and installed at the bottom edge of the cap 49 in a permanent manner using epoxy or adhesive or a similar material. A pair of leads 58 are connected to the reed switch 56 and emerge from the bottom of the flange for use in providing the abnormal level signal on line 36 of FIGS. 2 and 3. A mounting bracket assembly 60, 62 may be provided to provide adjustability of the operating level inside the switch.

When tubed into the dry lube applicator 26 of FIG. 3 and vented to atmosphere, the level inside the float switch will match that of the applicator if the two levels are capable of being in the same plane. By using the sliding bracket 60 (assuming the bracket 62 is permanently mounted to a fixed stanchion or the like), one may adjust the point at which the switch will trigger by moving the switch up or down from a point of reference. The float switch 34 of FIGS. 1 and 3 is particularly useful for wire fabrication processes in which the level of dry lubricant solution such as Lacolene TM solvent and beeswax solute. Of course, it will also be useful for other similar solvents of the aliphatic petroleum naphtha type and even other types of solvent not of that family. It will, of course, be understood that the float switch shown in FIG. 2 may also be used for purposes other than mere alarm sensing such as for control purposes.

Although the invention has been shown and described with respect to illustrated embodiments thereof, it should be understood by those skilled in the art that the foregoing and various other changes, omissions, and additions in the form and detail thereof may be made therein without departing from the spirit and scope of the invention.

I claim:

1. A level sensor (34), comprising:

a polypropylene bottle float (40);

a magnet (42), attached to said bottle float (40);

a vertically disposed PVC float tube (44) for floating said bottle float;

a mounting base (54);

an adapter (52), having a cavity therein for connecting said float tube (44) to said mounting base (54);

a tubing connector (50) for communicating fluid to and from said float tube;

a magnetic reed switch (56) sealed within said cavity for closing off said tube's (44) bottom and for actuation by proximity to said floating magnet according to the level in said float tube;

a cap (46), having a vent for closing off said tube's (44) top; and a vertically disposed adjustable bracket (60) having an elongated vertical slot and having a horizontal platform attached to said mounting base, said bracket for being mounted on a permanent fixture (62) for providing level adjustability for the level which causes actuation of said reed switch.

2. Apparatus, comprising:

a float;

a magnet attached to said float;

a float tube having a connector for fluid communication with a reservoir, said float tube for having a varying liquid level therein for floating said float and said magnet;

a reed switch disposed in said float tube for actuation by proximity to said magnet floating at a level in said float tube corresponding to a selected level in said reservoir; and a vertically disposed adjustable bracket having an elongated vertical slot and having a horizontal platform upon which said float tube is vertically mounted, said bracket for being mounted on a permanent fixture for providing level adjustability for the level which causes actuation of said reed switch.

* * * * *